US007827618B2

(12) United States Patent
Arthur-Mensah et al.

(10) Patent No.: US 7,827,618 B2
(45) Date of Patent: Nov. 9, 2010

(54) SINGLE/MULTIPLE USE LIQUID RESISTANT PROTECTOR

(76) Inventors: Bridgette Lucy Adwoa Ampobeng Arthur-Mensah, 60 Argent Dr., Highland, NY (US) 12528; Kojo Arthur-Mensah, 60 Argent Dr., Highland, NY (US) 12528

( * ) Notice: Subject to any disclaimer, the term of this patent is extended or adjusted under 35 U.S.C. 154(b) by 0 days.

(21) Appl. No.: 12/321,616

(22) Filed: Jan. 23, 2009

(65) Prior Publication Data

US 2009/0188016 A1 Jul. 30, 2009

Related U.S. Application Data

(60) Provisional application No. 61/062,450, filed on Jan. 26, 2008.

(51) Int. Cl.
*A41B 13/10* (2006.01)

(52) U.S. Cl. ..... 2/49.5; 2/49.1

(58) Field of Classification Search ..... 2/46, 2/49.1–49.5, 52, 51, 53, 48, 50, 468, 75, 2/80, 83, 97, 92, 104, 114, 135, 272, 207, 2/174

See application file for complete search history.

(56) References Cited

U.S. PATENT DOCUMENTS

| | | | | | |
|---|---|---|---|---|---|
| 439,736 | A | * | 11/1890 | Webber | 2/49.5 |
| 686,631 | A | * | 11/1901 | McCathie | 2/49.4 |
| 889,073 | A | * | 5/1908 | Walbridge | 2/49.1 |
| 1,193,545 | A | * | 8/1916 | Hart | 2/51 |
| 1,391,121 | A | * | 9/1921 | Keppel | 2/49.5 |
| 2,431,052 | A | * | 11/1947 | La Gier | 2/49.1 |
| 2,523,565 | A | * | 9/1950 | Gardner | 2/49.1 |
| 2,685,086 | A | * | 8/1954 | Henry | 2/55 |
| 3,488,773 | A | * | 1/1970 | Stemmer | 2/52 |
| 3,540,060 | A | * | 11/1970 | Brown | 2/49.2 |
| 4,622,698 | A | * | 11/1986 | Heyman et al. | 2/48 |
| 4,639,946 | A | * | 2/1987 | Koenig | 297/465 |
| 4,745,916 | A | * | 5/1988 | Seber | 128/858 |
| 4,787,099 | A | | 11/1988 | Mack | |
| 4,980,927 | A | * | 1/1991 | Wawiluk et al. | 2/60 |
| D341,922 | S | * | 12/1993 | Stocks | D2/861 |
| 5,432,952 | A | * | 7/1995 | Tate | 2/49.4 |
| 5,443,875 | A | * | 8/1995 | Liu | 428/41.9 |
| 5,454,119 | A | * | 10/1995 | Thomm | 2/114 |
| 5,491,844 | A | * | 2/1996 | Kehl et al. | 2/49.1 |
| 5,673,433 | A | * | 10/1997 | Rothrum | 2/46 |
| 5,881,382 | A | * | 3/1999 | Bernard et al. | 2/49.1 |
| 5,911,311 | A | * | 6/1999 | Hutchins | 2/49.5 |
| 6,216,269 | B1 | * | 4/2001 | Smith et al. | 2/46 |
| 6,256,788 | B1 | * | 7/2001 | Loewer et al. | 2/49.2 |
| 6,405,374 | B1 | * | 6/2002 | Giakas-Cano | 2/49.1 |
| 6,408,439 | B1 | * | 6/2002 | Garforth-Crippen | 2/80 |
| 6,493,879 | B1 | * | 12/2002 | Hibler | 2/49.1 |
| 7,237,271 | B1 | | 7/2007 | McLandrich | |

(Continued)

*Primary Examiner*—Amy B Vanatta
(74) *Attorney, Agent, or Firm*—Aziz M. Ahsan; Ahsan & Associates, PLLC

(57) ABSTRACT

The present invention relates generally to a non-permanent liquid resistant protector. More particularly the invention relates to single/multiple use non-permanent liquid resistant protector. The invention also relates to a bib protector and liner. The invention further encompasses a liquid resistant protector liner that can be temporarily attached and detached to another material via at least one securing or fastening means. Also disclosed is a bib liner that is either washable and reusable or disposable.

20 Claims, 2 Drawing Sheets

U.S. PATENT DOCUMENTS

| | | | | |
|---|---|---|---|---|
| 7,269,858 | B2 | 9/2007 | Rothschild | |
| 7,360,257 | B2 | 4/2008 | Friedland et al. | |
| 7,424,749 | B2 | 9/2008 | McCloskey et al. | |
| 2001/0047532 | A1* | 12/2001 | Marrero | 2/49.1 |
| 2003/0221236 | A1* | 12/2003 | Hippensteel | 2/46 |
| 2006/0026729 | A1* | 2/2006 | Rothschild | 2/49.1 |

* cited by examiner

SINGLE/MULTIPLE USE LIQUID RESISTANT PROTECTOR

CROSS-REFERENCE TO RELATED APPLICATION

The instant patent application is related to U.S. Provisional Patent Application Ser. No. 61/062,450, filed on Jan. 26, 2008, titled "HappyBaby bib is a removable liquid resistant attachment for cloth baby bibs . . . ," the entire disclosure of which is incorporated herein by reference.

FIELD OF THE INVENTION

The present invention relates generally to a non-permanent liquid resistant protector. More particularly the invention relates to single/multiple use non-permanent liquid resistant protector. The invention also relates to a bib protector and liner. The invention further encompasses a liquid resistant protector liner that can be temporarily attached and detached to another material via at least one securing or fastening means. Also disclosed is a bib liner that is either washable and reusable or disposable.

BACKGROUND INFORMATION

A bib is commonly referred to as a small piece of material that is positioned to hang from a person's neck, under a person's chin, and onto the wearer's chest area. Bibs help protect clothing, especially, while eating or drinking. Bibs are typically used while feeding infants, toddlers and small children. However, the use of bibs among adults is also present, especially, when they might be in a position to spill or splatter food onto their clothing. This could occur for a variety of reasons, such as, being disabled, due to age, during recovery from trauma, to name a few.

Conventional bibs typically have two strings which tie around the neck to hold the bib in place. Other bibs use snaps, ties, strings, hook and loop fasteners, or the like to attach around the neck. More recently, some bibs have eliminated the strings and ties altogether and have instead used adhesive strips or Velcro. These strips are located near the shoulder area on the backside of the bib and are used to securely adhere the bib to the wearer.

As is commonly known, bibs are usually worn during the feeding of infants and toddlers, however, bibs are also sometimes worn during the feeding of adults, especially, in a nursing home setting or for a variety of other reasons. With some infants and toddlers, it is not unusual to have to change their bibs up to say, 10 to 15 times a day, not only because of the food which drips upon the bib, but because they are teething or just tend to drool a lot of the time. As will be appreciated, such regular changing of bibs is necessary in order to keep the infant's or toddler's underclothes dry and to keep the infant or toddler from becoming unduly wet. This is particularly important in cold weather locations. Because infants and toddlers tend to teethe for many months, beyond one-year of age, the situation becomes quite frustrating for a mother to continue to have to wash the infant's or toddler's clothes and body over-and-over again because of the limited protection that conventional bibs offer.

U.S. Pat. No. 4,787,099 (Robert J. Mack), the disclosure of which is incorporated herein by reference, discloses a disposable limited reusable bib comprising a sheet of non-woven hydrophobic material having a weight of from 20 grams to 100 grams per square yard and having a plurality of projecting nubbins for simulating a terrycloth appearance for facilitating wiping and food catching.

U.S. Pat. No. 7,237,271 (Andrew Barber McLandrich), the disclosure of which is incorporated herein by reference, discloses a disposable protective bib comprising a generally rectangular sheet of flexible, liquid-impervious material. The bib has a top portion comprising a yoke to accommodate the user's neck and a bottom portion comprising at least one fastening element for securing the bib to a table. The bib forms a pocket between the wearer and the table to catch food and beverages that may be spilled. The yoke comprises at least one perforated tear section to release the bib from the wearer.

U.S. Pat. No. 7,269,858 (Deborah V. Rothschild), the disclosure of which is incorporated herein by reference, discloses a reversible, multi-purpose bib exhibiting a polyester layer on one side for use in absorbing drool, a vinyl layer on an opposing side for use when feeding solid food, and a removable overlying cotton or cotton polyester blend layer atop the vinyl layer for use when formula feeding.

U.S. Pat. No. 7,360,257 (Frank Friedland, et al.), the disclosure of which is incorporated herein by reference, discloses a bib for protecting clothing and includes a sheet having front and back surfaces, an adhesive strip located on the back surface of the sheet and configured and dimensioned for adhering the sheet to the wearer, and a sealed package attached to the sheet. The sealed package includes at least one towelette configured and dimensioned for cleansing.

U.S. Pat. No. 7,424,749 (Edward McCloskey, et al.), the disclosure of which is incorporated herein by reference, discloses a disposable dribble bib for babies comprising a shaped panel of non-woven cotton material. The bib has an outer face and an inner face each of which has a hairy surface formed by cotton fibers which when the bib is placed on a garment will attach and hold the bib on the garment. The bib is simple and cheap to manufacture and is double sided, that is it can be used either way round with either the outer face or inner face engaging the garment. A neck-receiving recess is provided at an upper end of the bib.

U.S. Patent Publication No. 2001/0047532 (A. Leslie Marrero), the disclosure of which is incorporated herein by reference, discloses a disposable bib, comprising a liquid-permeable top layer (18), an absorbent inner-core (20), a waterproof, air-permeable back layer (22). Each layer is configured to provide an apron (10), while the top and back layers continue to flow in continuous format to provide a C shaped collar (12). An adhesive bond (24) is provided throughout the bib to adhere each layer, one to another, and configured within the apron (10) to provide a cross-stitch pattern equivalent to quilting, to aid in controlling the expansion of the absorbent inner-core. The bib is preferably constructed from biodegradable materials.

Even with these improvements, a need exists for an improved bib and a bib liner.

Additionally, a need also exists for an improved bib liner or a bib protector.

A need also exists for a bib liner that is disposable.

Furthermore, a need also exists for a bib liner that can be attached and detached to any bib and is reusable.

This invention overcomes the problems of the prior art. The invention provides a bib liner that protects a user from getting wet from fluid spills and the like.

PURPOSES AND SUMMARY OF THE INVENTION

The invention is a novel bib liner and a method of making the same.

Therefore, one purpose of this invention is to provide a bib liner that is disposable.

Another purpose of this invention is to provide a bib liner that can be attached and detached from any bib and is reusable.

Yet another purpose of this invention is to have a bib liner that can be securely adhered to any cloth bib.

Still, yet another purpose of this invention is to have a bib liner that has at least two wings that can loop around a conventional bib and securely adhere the bib liner to any bib.

Yet another purpose of this invention is to provide an improved and efficient method of making a bib liner.

Therefore, in one aspect this invention comprises a bib liner, comprising:

(a) at least one layer of a liquid resistant protector sheet;

(b) at least one securing means secured to said at least one layer of said liquid resistant protector sheet, and thereby forming said bib liner.

In another aspect this invention comprises a bib liner, comprising:

(a) at least one layer of a liquid resistant protector sheet;

(b) at least one layer of at least one adhesive material for securing said liquid resistant protector sheet to a bib material; and (c) at least one layer of a backing sheet, wherein said backing sheet protects at least a portion of said liquid resistant protector sheet and at least a portion of said at least one adhesive material.

In yet another aspect this invention comprises a bib liner, comprising:

(a) at least one layer of a liquid resistant protector sheet, wherein said liquid resistant protector sheet has a first liner extension and a second liner extension, said first liner extension has a first upper extension and a first lower extension, and said second liner extension has a second upper extension and a second lower extension and thereby forming said bib liner; and (b) at least one securing means for securing said liquid resistant protector sheet to a bib material.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

DETAILED DESCRIPTION

Figure 1:
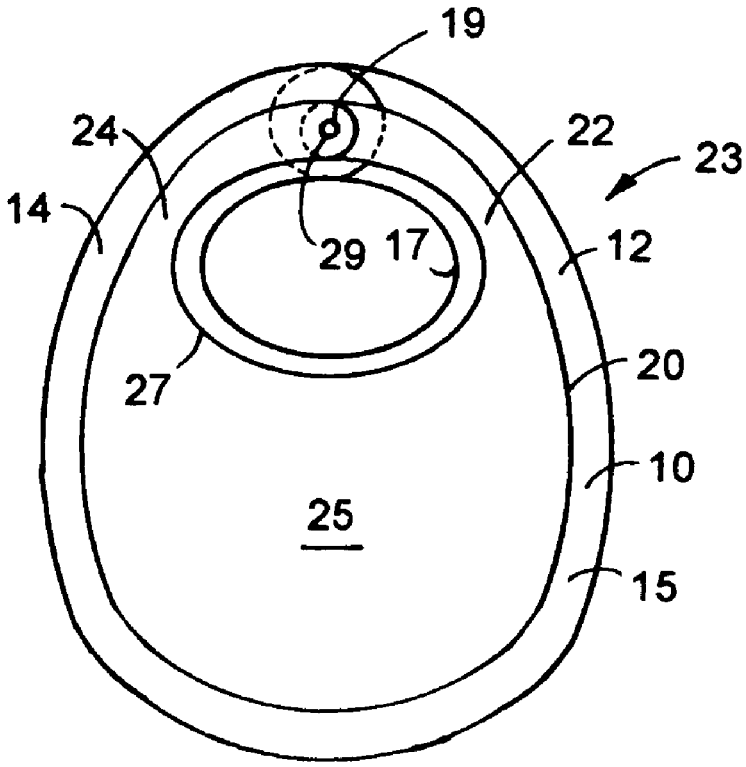
FIG. 1 is an exemplary bib and liquid resistant protector which is used to illustrate a first embodiment of the present invention.

FIG. 1 is an exemplary bib 10, and liquid resistant protector or bib liner 20, which is used to illustrate a first embodiment of the present invention 23. The bib 10, is a conventional type bib 10, having a bib body section or portion 15, a first bib extension or arm 12, a second bib extension or arm 14, and forming a bib neck opening 17. The first bib extension 12, and the second bib extension 14, meet and are secured each to the other using at least one first securing means 19. The bib liner 20, preferably follows the contours of the conventional type bib 10, such as, by having a bib liner body section or portion 25, a first bib liner extension or arm 22, a second bib liner extension or arm 24, and forming a bib liner neck opening 27. The first bib liner extension 22, and the second bib liner extension 24, meet and are secured each to the other using at least one second securing means 29. The first securing means 19, could also be the same as the second securing means 29, that could be used to secure the first bib liner extension 22, to the second bib liner extension 24, or they could be a different second securing means 29. However, it should be appreciated that the bib liner 20, is secured to the bib 10, via at least one securing means, such as, first securing means 19, and/or second securing means 29, so that both the bib liner 20, and the bib 10, are always coupled each to the other during the use of either the bib 10, or the bib liner 20. It should be understood that one face of the bib liner 20, faces the user or his/her clothes while the other face of the bib liner 20, is in contact with the backside of the bib 10, thus the bib liner 20, is always in between the user or wearer (not shown) and the bib 10. The bib liner 20, can be of the same size as the bib 10, or it could be smaller in size than the bib 10, or it could be larger in size than the bib 10. However, it is preferred that at least a portion of the bib liner body section 25, overlaps with at least a portion of the bib body section 15. The bib liner 20, could be of the same or similar size and shape as the bib 10, or it could be bigger in shape or size than the bib 10, or it could be smaller in shape or size than the bib 10.

Figure 2A:
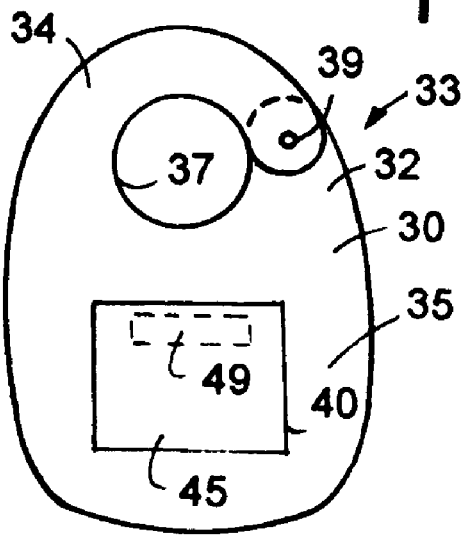
FIG. 2A is an exemplary bib and liquid resistant protector which is used to illustrate a second embodiment of the present invention.

FIG. 2A is an exemplary bib 30, and a liquid resistant protector or bib liner 40, which is used to illustrate a second embodiment of the present invention 33. The bib 30, is a conventional type bib 30, having a bib body section or portion 35, a first bib extension or arm 32, a second bib extension or arm 34, and forming a bib neck opening 37. The first bib extension 32, and the second bib extension 34, meet and are secured each to the other using at least one securing means 39. The bib liner 40, is preferably a little bit smaller in area than the conventional type bib 30. The bib liner 40, has a bib liner body section or portion 45, and is secured to the bib 30, via at least one securing means 49. It is preferred that at least a portion of the body portion 45, of the bib liner 40, overlaps with at least a portion of the bib 30.

Figure 2B:
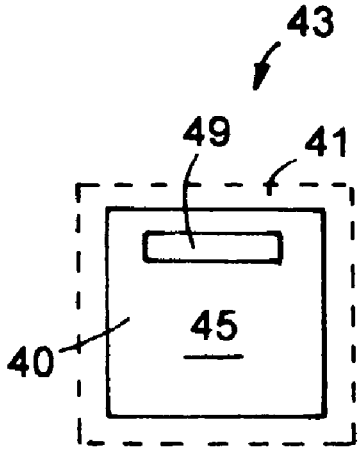
FIG. 2B is an exemplary liquid resistant protector of FIG. 2A, with a backing sheet which is used to further illustrate the present invention.

FIG. 2B is an exemplary liquid resistant protector or bib liner 40, of FIG. 2A, with at least one backing sheet 41, which is used to further illustrate the present invention 43. The backing sheet 41, is peeled off prior to the securing of the bib liner 40, to the bib 30, via the at least one securing means 49. The backing sheet 41, also protects the securing means 49, as well as at least a portion of the bib liner 40.

Figure 3:
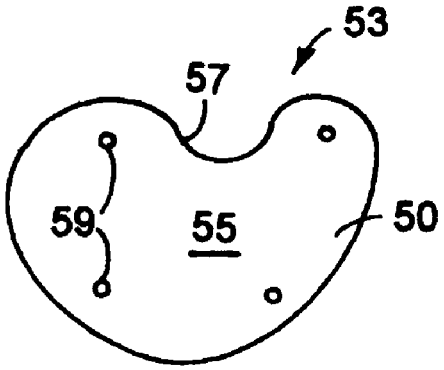
FIG. 3 is an exemplary liquid resistant protector which is used to illustrate a third embodiment of the present invention.

FIG. 3 is an exemplary liquid resistant protector or bib liner 50, which is used to illustrate a third embodiment of the present invention 53. The bib liner 50, has bib liner neck area 57, a bib liner body section or portion 55, and at least one securing means 59. The securing means 59, securing the bib liner 50, to a bib, such as, the bib 10, or the bib 30.

Figure 4:
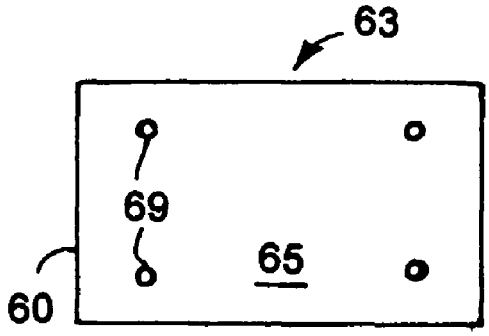
FIG. 4 is an exemplary liquid resistant protector which is used to illustrate a fourth embodiment of the present invention.

FIG. 4 is an exemplary liquid resistant protector or bib liner 60, which is used to illustrate a fourth embodiment of the present invention 63. The bib liner 60, has a bib liner body section or portion 65, and at least one securing means 69. The securing means 69, securing the bib liner 60, to a bib, such as, the bib 10, or the bib 30.

Figure 5:
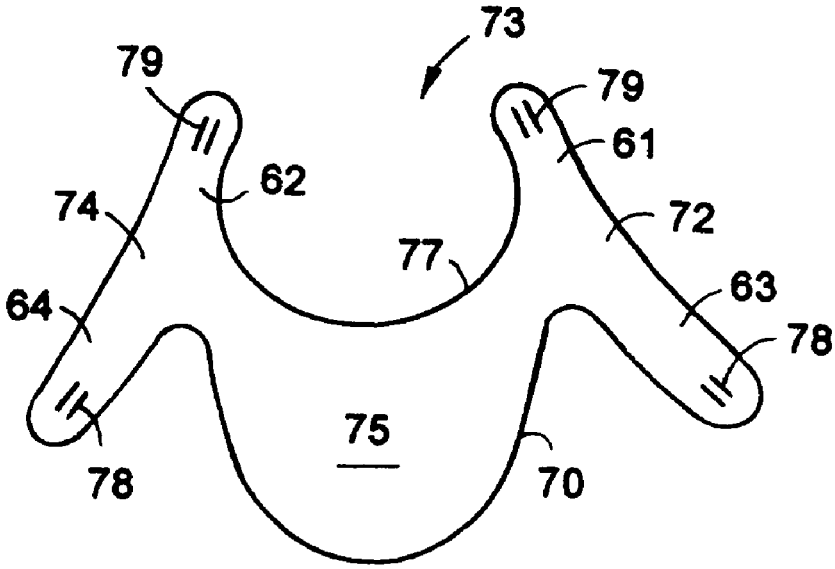
FIG. 5 is an exemplary liquid resistant protector which is used to illustrate a fifth embodiment of the present invention.

FIG. 5 is an exemplary liquid resistant protector or bib liner 70, which is used to illustrate a fifth embodiment of the present invention 73. The bib liner 70, has bib liner neck area 77, a bib liner body section or portion 75, and at least one securing means 78, 79. The bib liner 70, has a first bib liner arm or extension 72, and a second bib liner arm or extension 74. The first bib liner arm or extension 72, has a first upper extension 61, having at least one securing means 79, and a first lower extension 63, having at least one securing means 78. The second bib liner arm or extension 74, has a second upper extension 62, having at least one securing means 79, and a second lower extension 64, having at least one securing means 78. In order to securely attach the bib liner 70, to a bib, such as, bib 10, or bib 30, the first bib liner extension 72, is positioned above a first bib extension, such as, the first bib extension 12, in the bib 10, or the first bib extension 32, in the bib 30, and then the first bib liner extension 72, is looped around and securing means 78, are securing to secured means 79. Similarly, the second bib liner extension 74, is positioned above a second bib extension, such as, the second bib extension 14, in the bib 10, or the second bib extension 34, in the bib 30, and then the second bib liner extension 74, is looped around and securing means 78, are secured to secured means 79. Once the bib liner 70, is securely adhered to the bib 10, or the bib 30, the bib liner acts as a protector between the bib 10, or bib 30, and the user (not shown) or the user's clothing (not shown).

The backing sheet 41, or similar such protective sheet 41, is preferably used when the securing means, such as, securing means 29, 49, 59, 69, 78, 79, needs protection from the elements prior to its use, such as, for example, the securing means 29, 49, 59, 69, 78, 79, is for example, a strip of an adhesive tape 29, 49, 59, 69, 78, 79, and any exposure to the elements prior to use may reduce its adhesion properties, and so in such cases a backing sheet 41, would be appropriate to protect it from the environment. However, if the securing means 29, 49, 59, 69, 78, 79, is a patch of Velcro 29, 49, 59, 69, 78, 79, then a backing type sheet 41, would not be needed.

It should be appreciated that the bib liner 20, 40, 50, 60, 70, is a removable and a non-permanent liquid resistant attachment for cloth baby bibs 10, 30, and can be available in several formats, such as, (a) disposable or single use only, (b) reusable attachment, suitable for use with any cloth bib, (c) a custom cloth bib with a detachable reusable water resistant attachment, to name a few.

As stated earlier the disposable liquid resistant attachment or bib liner with an adhesive can be attached to the back of any existing cloth bib. One could also have a detachable but reusable liquid resistant attachment or bib liner, which can be attached to any cloth bib with an attachment at the back of the neck area. One could also have a detachable/reusable liquid resistant attachment or bib liner which attaches to a custom bib.

One advantage of this inventive bib and bib liner is to provide additional protection for a baby's clothing at a very low cost. The attachment provides protection for a baby's clothing against liquid and/or food spills. As stated earlier the liquid resistant attachment or bib liner goes behind a cloth bib, which absorbs liquids, and acts as a water resistant barrier to keep the user's clothes dry, such as, an infant's or toddler's clothes or an incapacitated individual's clothes. In some cases the water resistant part of the bib can be detached and wiped clean with a damp cloth while the cloth section can be laundered. This keeps the water resistant section from deteriorating and losing its effectiveness and looking tawdry. Existing bibs that have a permanently attached protective layer do not wash well and also tend to be stiff.

The inventive bib liner when attached to a normal cloth bib provides an affective water resistant barrier that allows a baby or a toddler or an incapacitated individual to remain dry even when their bib is thoroughly soaked with liquid. Any of the embodiments can be cleaned and reused. Similarly, any of the embodiments illustrated can be a disposable version and only be good for a single use.

This invention also allows the user to continue using their old soft cloth bibs that are easy to use and safe for babies to chew on and adds the protection of a water resistant layer underneath when required. This also allows the user the flexibility of using the protective layer when needed so instead of perhaps having 10 cloth bibs and 10 bibs with the permanent attachment, one can have 10 cloth bibs and at least 1 reusable protective layer or the inventive bib liner. This further allows one to have the benefit of two different types of bibs without spending a lot of money.

As shown in FIG. 2B, which could also be a disposable bib liner 40, the securing means 49, could be a narrow strip of an adhesive 49, which could cover a small narrow area, as illustrated in FIG. 2B, or the adhesive 49, could cover the entire non-woven area of the bib liner 40.

During the application of the bib liner 40, to the bib 30, one would place the bib liner 40, flat with the fabric side facing down. One would then peel off the backing sheet or material 41, and attach the adhesive side 49, of the bib liner 40, to the back of the cloth bib 30, just below the neck line 37. After the securing of the bib liner 40, the bib 30, now providing liquid resistance protection can be normally used. Once it is noticed that the bib 30, has become wet or soggy one would first remove the bib 30, from around the person's neck and grab the edge of the bib liner 40, and peel it off from the soiled bib 30. However, if the used bib liner 40, is the disposable version then it can now be tossed into a trash can. For some versions the single use bib liner can be a flushable bib liner and can be flushed down a toilet.

The securing means 29, 49, 59, 69, 78, 79, could be selected from a group comprising an adhesive, a glue, an adhesive type tape, an adhesive type strip, Velcro, zip, button, thread, fastening, hooks, snaps, ties, strings, hook and loop fasteners, or the like, to name a few. One could also use solvent based tissue adhesive, which could gently and securely attach a disposable bib liner to any bib.

The securing means 19 and 39, could be selected from a group comprising an adhesive, a glue, an adhesive type tape, an adhesive type strip, Velcro, zip, button, thread, fastening, hooks, snaps, ties, strings, hook and loop fasteners, or the like, to name a few.

The single use liquid resistant protector or bib liner can be made from a material selected from a group comprising, woven material, non-woven material, natural material, artificial fibrous material, to name a few.

It is preferred that the inventive bib liner or liquid resistant protector of this invention be used with a non-disposable type material or bib. As one can appreciate, the bib and the bib liner are two separate pieces, and these two pieces are temporarily secured each to the other only when there is a risk of the bib being exposed to significant volumes of a liquid.

The inventive bib and bib liner are currently being marketed as "Wow Baby" and are further described at the website: www.awowbaby.com.

It should be understood that the inventive liquid resistant protector or bib liners can be used with any kind of bib, burp cloths, garments (that require protection from liquids), bed linens, aprons, clothing, to name a few. The liquid resistant liner or the bib liner could be made from soft spun lace non-woven fabric.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A combination bib and bib liner garment, comprising:

(a) a bib having a bib body portion, a first bib extension, a second bib extension, and wherein said first bib extension is secured to said second bib extension to define a bib neck opening, said bib body portion having a face surface and a back surface, said back surface having at least one back surface securing means area;

(b) a bib liner having a bib liner body portion, wherein said bib liner is at least one layer of a liquid resistant protector sheet, said bib liner body portion having a face surface and a back surface, said face surface having at least one face surface securing means; and (c) wherein said at least one back surface securing means area of said bib body portion accepts said at least one face surface securing means of said bib liner body portion, such that said bib body portion and said bib liner body portion are secured to each other in a temporary and removable manner, and wherein said back surface of said bib body portion is in contact with said face surface of said bib liner body portion, and upon contact said bib body portion and said bib liner form an exterior contact with each other, and thereby forming said combination bib and bib liner garment.

2. The combination bib and bib liner garment of claim 1, wherein at least one layer of a backing sheet protects at least a portion of said at least one layer of said liquid resistant protector sheet and at least a portion of said at least one face surface securing means, and wherein said at least one layer of said backing sheet is removed prior to securing said bib liner to said bib.

3. The combination bib and bib liner garment of claim 1, wherein said at least one layer of said liquid resistant protector sheet is a non-permanent liquid resistant protector sheet.

4. The combination bib and bib liner garment of claim 1, wherein said at least one face surface securing means is selected from a group consisting of an adhesive, a glue, an adhesive type tape, an adhesive type strip, zip, button, thread, hooks, snaps, ties, strings, hook and loop fasteners.

5. The combination bib and bib liner garment of claim 1, wherein said at least one face surface securing means is a solvent based tissue adhesive.

6. The combination bib and bib liner garment of claim 1, wherein material for said liquid resistant protector sheet is selected from a group consisting of woven material, non-woven material, natural material, and artificial fibrous material.

7. The combination bib and bib liner garment of claim 1, wherein said bib is selected from a group consisting of a burp cloth, a garment, an apron, and a cloth material.

8. The combination bib and bib liner garment of claim 1, wherein said liquid resistant protector sheet is made from a soft spun lace non-woven fabric.

9. The combination bib and bib liner garment of claim 1, wherein at least a portion of said liquid resistant protector sheet overlaps with at least a portion of said bib body portion.

10. The combination bib and bib liner garment of claim 1, wherein at least a portion of an outer edge of said liquid resistant protector sheet overlaps with at least a portion of said bib.

11. The combination bib and bib liner garment of claim 1, wherein after said liquid resistant protector sheet is secured to said bib via said at least one face surface securing means, said bib is secured around the neck of a user via at least one additional securing means.

12. The combination bib and bib liner garment of claim 11, wherein said additional securing means is selected from a group consisting of an adhesive, a glue, an adhesive type tape, an adhesive type strip, zip, button, thread, hooks, snaps, ties, strings, hook and loop fasteners.

13. A combination bib and bib liner garment, comprising:

(a) a bib having a bib body portion, a first bib extension, a second bib extension, and wherein said first bib extension is secured to said second bib extension to define a bib neck opening, said bib body portion having a face surface and a back surface, said back surface having at least one back surface securing means;

(b) a bib liner having a bib liner body portion, a first bib liner extension, a second bib liner extension, and wherein said first bib liner extension is secured to said second bib liner extension to define a bib liner neck opening, wherein said bib liner is at least one layer of a liquid resistant protector sheet, said bib liner body portion having a face surface and a back surface, said face surface having at least one face surface securing means area; and (c) wherein said at least one back surface securing means of said bib body portion accepts said at least one face surface securing means area of said bib liner body portion, such that said bib body portion and said bib liner body portion are secured to each other in a temporary and removable manner, and wherein said back surface said bib body portion is in contact with said face surface of said bib liner body portion, and upon contact said bib body portion and said bib liner form an exterior contact with each other, and wherein at least a portion of said bib neck opening overlaps with at least a portion of said bib liner neck opening, and thereby forming said combination bib and bib liner garment.

14. The combination bib and bib liner garment of claim 13, wherein said at least one back surface securing means is selected from a group consisting of an adhesive, a glue, an adhesive type tape, an adhesive type strip, zip, button, thread, hooks, snaps, ties, strings, hook and loop fasteners.

15. The combination bib and bib liner garment of claim 13, wherein material for said liquid resistant protector sheet is selected from a group consisting of woven material, non-woven material, natural material, and artificial fibrous material.

16. The combination bib and bib liner garment of claim 13, wherein said bib is selected from a group consisting of a burp cloth, a garment, an apron, and a cloth material.

17. The combination bib and bib liner garment of claim 13, wherein said liquid resistant protector sheet is made from a soft spun lace non-woven fabric.

18. The combination bib and bib liner garment of claim 13, wherein at least a portion of said liquid resistant protector sheet overlaps with at least a portion of said bib body portion.

19. A combination bib and bib liner garment, comprising:

(a) a bib liner having a bib liner body portion, wherein said bib liner is at least one layer of a liquid resistant protector sheet, said bib liner body portion having a face surface and a back surface, said face surface having at least one face surface securing means; and (b) a bib having a bib body portion, a first bib extension, a second bib extension, and wherein said first bib extension is temporarily and removeably secured to said second bib extension to define a bib neck opening, said bib body portion having a face surface and a back surface, said back surface having at least one area for securing said at least of face surface securing means of said bib liner, such that said bib body portion is secured to said bib liner body portion, and wherein said bib body portion and said bib liner body portion are secured to each other in a temporary and removable manner, and wherein said back surface of said bib body portion is in contact with said face surface of said bib liner body portion, and upon contact said bib body portion and said bib liner form an exterior contact with each other, and thereby forming said combination bib and bib liner garment.

20. The combination bib and bib liner garment of claim 19, wherein said at least one face surface securing means is selected from a group consisting of an adhesive, a glue, an adhesive type tape, an adhesive type strip, zip, button, thread, hooks, snaps, ties, strings, hook and loop fasteners.

* * * * *